US005582223A

United States Patent [19]

Weh et al.

[11] Patent Number: 5,582,223

[45] Date of Patent: Dec. 10, 1996

[54] FILLING APPARATUS FOR GAS BOTTLE VALVES

[75] Inventors: Wolfgang Weh; Erwin Weh, both of Illertissen, Germany

[73] Assignee: Weh GmbH, Verbindungstechnik, Illertissen, Germany

[21] Appl. No.: 314,043

[22] Filed: Sep. 28, 1994

[30] Foreign Application Priority Data

Sep. 29, 1993 [DE] Germany ..... 9314738 U

[51] Int. Cl.[6] ..... B65B 1/04; B65B 3/00

[52] U.S. Cl. ..... 141/383; 141/20; 141/62; 141/312; 285/178

[58] Field of Search ..... 141/18, 20, 62, 141/312, 383–386, 346, 368, 311; 137/798, 908; 285/178, 314, 311, 312, 197; 128/201.28, 201.24; 277/165; 604/70

[56] References Cited

U.S. PATENT DOCUMENTS 1,784,821 12/1930 Crowley ..... 285/312
1,832,639 11/1931 Kneeland ..... 141/383
1,936,868 11/1933 Whitney ..... 285/197
4,614,348 9/1986 Fournier ..... 277/165
5,131,625 7/1992 Hacker et al. ..... 141/383

*Primary Examiner*—Henry J. Recla
*Assistant Examiner*—Steven O. Douglas
*Attorney, Agent, or Firm*—Knobbe, Martens, Olson & Bear

[57] ABSTRACT

In order to provide a simple and reliably operating filling apparatus, particularly for pin-index gas bottle valves there is proposed a housing, a through opening formed in the housing for displaceable reception of a corresponding gas bottle valve, a filling union section fixed to the housing and opening into the through opening by way of a sealing neck, and a displacement member by means of which the sealing neck can be connected to a gas bottle valve located in the through opening.

24 Claims, 4 Drawing Sheets

FILLING APPARATUS FOR GAS BOTTLE VALVES

This invention relates to a filling apparatus for so-called pin index gas bottle valves and similar gas bottle valves.

FIELD OF THE INVENTION

Such gas bottle valves are in use predominantly in Anglo-Saxon regions and, for filling with CO2 or oxygen for example, have a standardised receiving arrangement of openings, as well as their unions. This receiving arrangement ensures that only the unions matched to this gas bottle valve type can be used and that no mixing up can take place.

SUMMARY OF THE INVENTION

The object of the invention is to provide a simple and reliably operating filling apparatus, with which filling of such a gas bottle valve can be carried out reliably even by laymen.

According to the invention there is provided a filling apparatus for gas bottle valves, consisting of a housing, a through opening formed in the housing for displaceable reception of a corresponding gas bottle valve, a filling union section fixed to the housing and opening into the through opening by way of a sealing neck, and a displacement member by means of which the sealing neck can be connected to a gas bottle valve located in the through opening.

PREFERRED EMBODIMENTS OF THE INVENTION

According to a preferred form of the invention, in order to improve the sealing properties and at the same time to secure the filling position of the filling apparatus, it is advantageously provided that the filling union section comprises a sealing neck formed as a separate, radially sealed, hollow connecting piston which has at least one surface acted on axially by the filling medium and is resiliently biased in the connection direction to improve the seal. In this way, the filling medium can, after attachment of the filling apparatus, act effectively on the connecting piston which is preferably guided in the filling union section, so as to increase the sealing pressure thereof on the gas bottle valve, while the displacement member can, on account of the reaction forces on the housing, also be secured in its advanced position which is preferably attained by means of an eccentric actuator, an abutment surface preferably being formed on the eccentric actuator for securing the position.

Alternatively, an externally operable detent member is provided in the region of the eccentric actuator for securing the position of the displacement member, especially with a filling union section formed in one piece, without a connecting piston. The eccentric is preferably operable by means of a rotary handle or a pivoted lever.

According to a preferred further development, the sealing neck, which is formed either directly on the filling union section or on the connecting piston, comprises a sealing arrangement with an O-ring and a PTFE ring on the valve side.

The connecting piston can be guided in the housing itself. However it is preferably guided in the filling union section.

According to another development of the invention, the displacement member is formed like a pin and is biased away from its direction of entry into the through opening by means of a spring, whereby it always advantageously bears on the eccentric actuator.

The filling union section fixed to the housing is formed according to a preferred embodiment of the invention as a separate part and is fixed in the housing either by fixing bolts or preferably by screwing in. An inlet filter, if desired a replaceable inlet filter, is advantageously fitted on or in the filling union section.

DETAILED DESCRIPTION OF THE INVENTION

Further details, features and advantages of the invention are to be found in the following description, in which embodiments of the invention are explained in more detail with reference to the drawings, in which.

Figure 1:
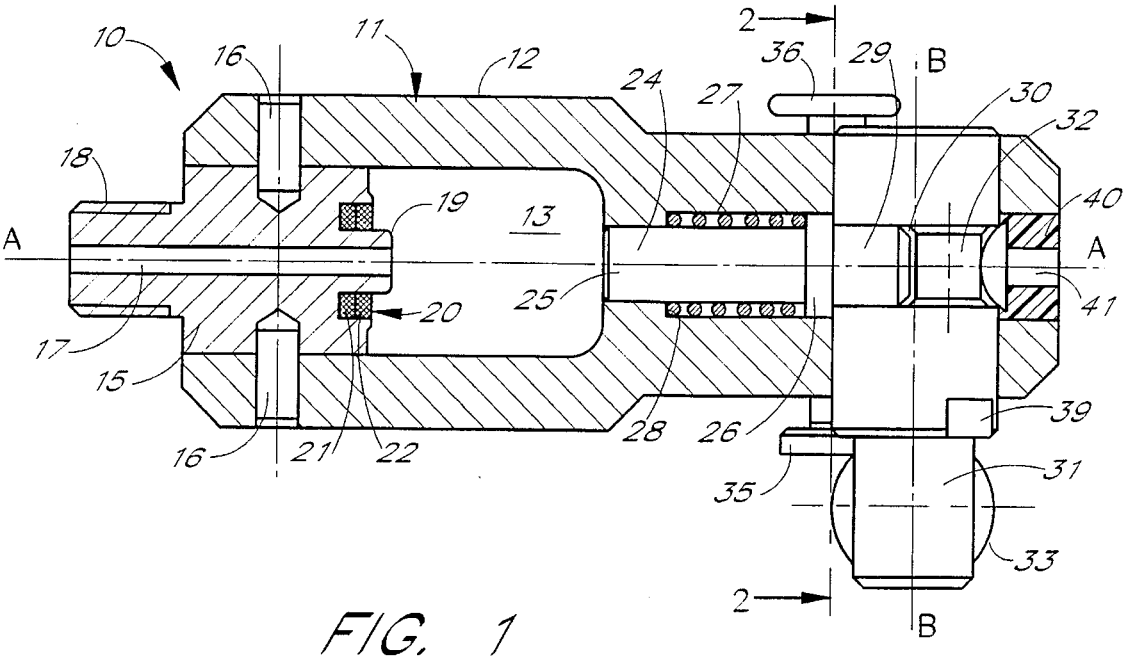
FIG. 1 shows a section through a first embodiment of a filling apparatus with a pivoted lever actuator and an externally operable detent member.
Figure 3:
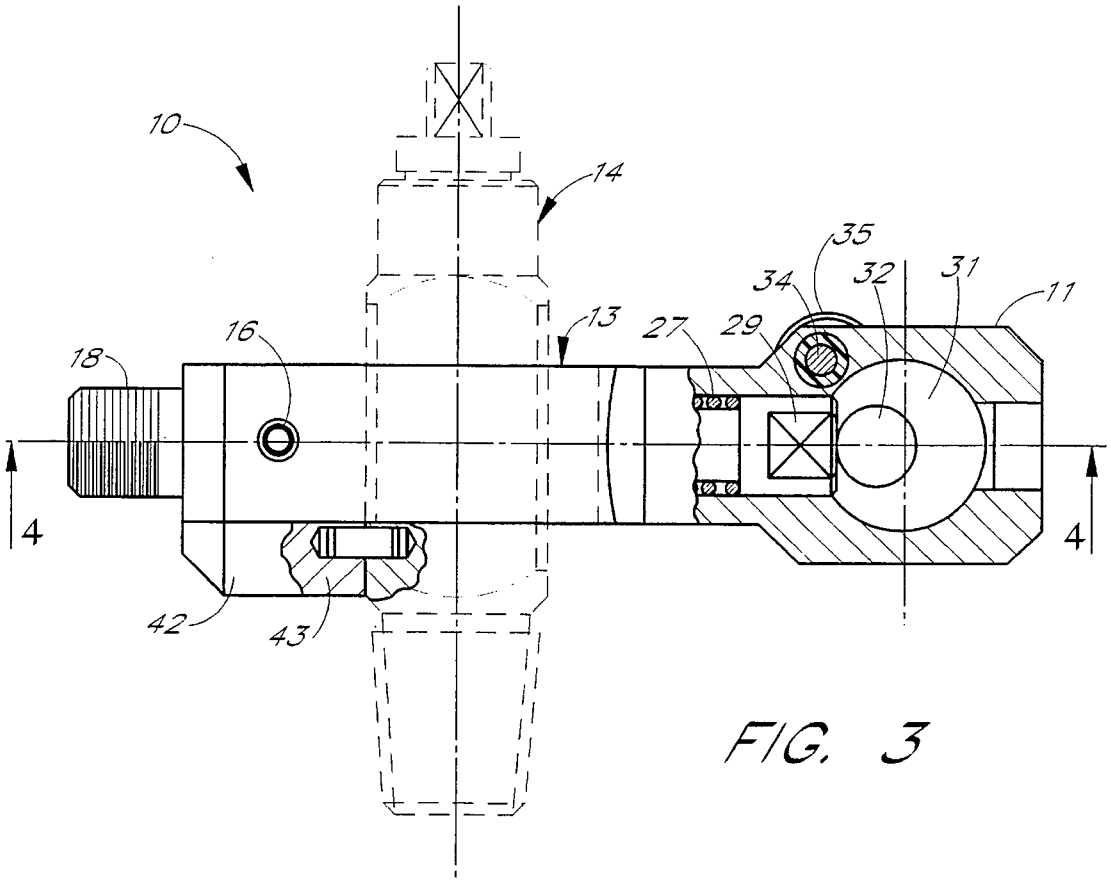
FIG. 3 is a partially broken away side view of the filling apparatus of FIG. 1, which is connected to a pin index gas bottle valve shown in broken lines.
Figure 4:
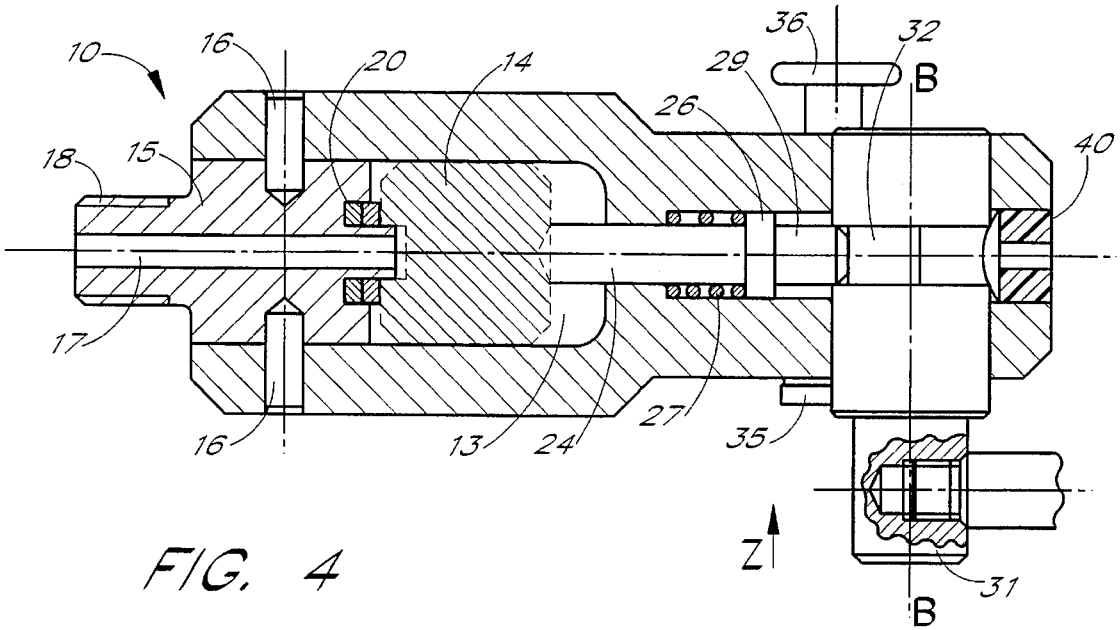
FIG. 4 is a section along the section line IV—IV in FIG. 3.

A first embodiment of a filling apparatus 10 for gas bottle valves is shown in section in FIG. 1. The filling apparatus 10 comprises a frame-like housing 11, on which a forked section 12 is formed, in which there is a through opening 13 for displaceable reception of a corresponding gas bottle valve 14, which is shown in broken lines in FIGS. 3 and 4.

A filling union section 15 fits closely in the forked section 12 of the housing 11 and is fixed by means of bolts 16. The filling union section 15 has a through bore 17, which runs from a threaded union 18 for attachment of a filling hose, not shown, on the longitudinal axis A—A (cf. FIG. 1 and FIG. 3) and opens into the through opening 13 at an insertion neck 19. The insertion neck 19 is formed as a ring and serves for introduction into the valve opening of the gas bottle to be filled. The filling neck 19 is surrounded by an annular sealing arrangement 20, which consists of an O-ring 21 and a PTFE ring 22 for sealing against the bottle valve.

The through opening 13 is matched to the standardised width of the gas bottle valve 14 and is oversized in the direction of the depth of the gas bottle valve 14, in order to make possible relative movement between the gas bottle valve 14 and the housing 11 for sealed connection of the filling apparatus 10, as will be explained in more detail below.

Figure 2:
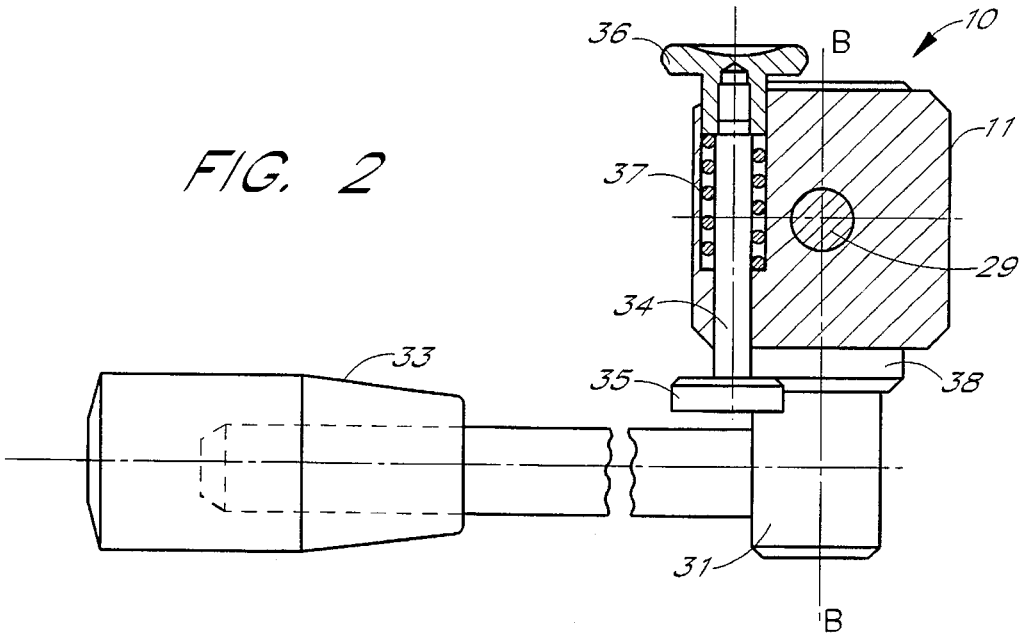
FIG. 2 is a section through FIG. 1 in the region of the detent member.
Figure 5:
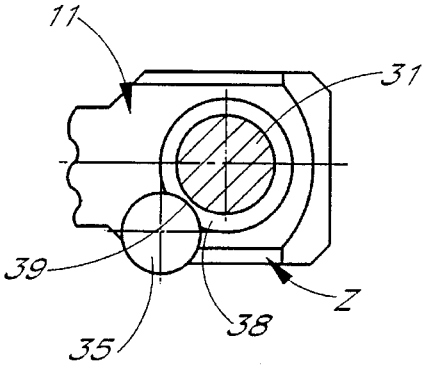
FIG. 5 is a partial view in the direction of the arrow Z in FIG. 4.

A displacement member 24 in the form of a pin is further mounted to shift in the housing 11, its longitudinal axis of symmetry coinciding with the longitudinal axis A—A of the housing. The displacement member 24 also opens into the through opening 13 at its actuating end 25. It has a collar 26 on which bears a compression spring 27, this bearing at its other end against an abutment 28 formed in the housing 11. Behind the collar 26 there is a square guide section 29 on the displacement member 24, this section engaging in an eccentric groove 30 of an eccentric shaft 31, which is mounted in the housing 11 perpendicular to the longitudinal axis A—A, and bearing at its end on an actuating section 32 formed eccentrically relative to the axis B—B of the eccentric, biased by the pressure of the spring 27. The eccentric shaft 31 is swung by means of a handle 33, as is better seen in FIGS. 2 and 4. In order to secure the pivoted position of the eccentric shaft 31 there is further provided a safety pin 34 with an engagement and retaining section 35 parallel to the axis B—B near to the eccentric shaft 31, wherein the engagement and retaining section 35 comes out of a receiving section 39 formed in a shaft flange 38 of the eccentric shaft 31 on pressing in the safety pin 34 by a knob 36, against the action of the compression spring 37, and allows rotation of the eccentric shaft 31; cf. FIG. 5.

The housing 11 is closed in the region of the longitudinal axis A—A near the eccentric shaft 31 by means of a bush 40, which has an air vent bore 41. It can be seen from FIG. 3 that a projection 42 is provided on the filling union section 15 on its underside, which has projecting pins 43 on its flat side facing towards the through opening 13 in an arrangement relative to the longitudinal axis A—A matched to the standardised pin index constellation for specific kinds of gas.

The displacement member 24 must firstly be in the position shown in FIG. 1 for fitting the filling apparatus 10. The valve 14 of the gas bottle to be filled in then fitted into the through opening 13 and the pins 43 are fitted into the bores on the side of the bottle valve, so that the insertion neck 19 already lies in the filling opening of the gas bottle valve. As soon as this relative arrangement between the gas bottle valve 14 and the housing 11 has be attained, it only necessary to swing the handle 33 until the engagement and retaining section 35 of the safety pin 34 clicks into the recess 39. The displacement member 24 is thereby engaged by the actuating section 32 on the gas bottle valve 14 and ensures the sealed connection of the filling apparatus 10 on the gas bottle valve 14 by a movement of the housing 11 relative thereto. The bottle filling operation can now be carried out. On completion, the release of the filling apparatus takes place in reverse order.

Figure 6:
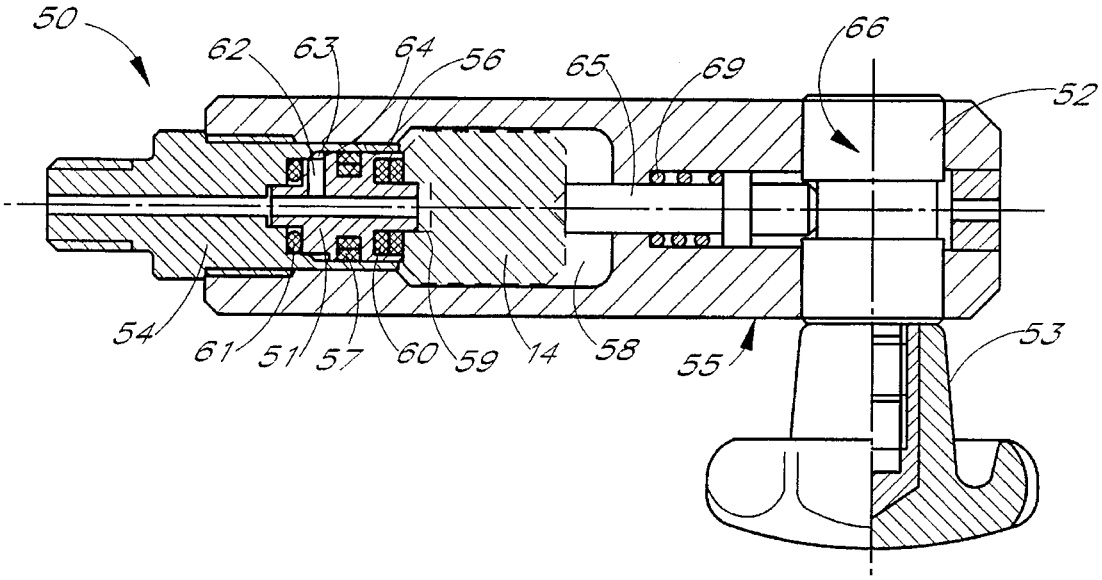
FIG. 6 is a sectional view of another embodiment of a filling apparatus with an additional connecting piston and a rotary handle actuator for the eccentric, wherein a pin index gas bottle valve is shown in section in the through opening in the connected position.
Figure 7:
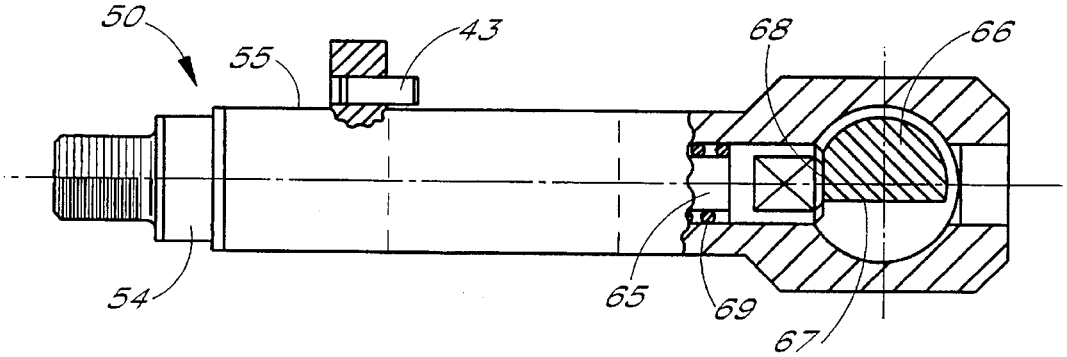
FIG. 7 is a side view of the filling apparatus according to FIG. 6, partially sectioned in the region of the eccentric actuator and the pin index pin arrangement.

A further embodiment of a filling apparatus 50 is shown in FIGS. 6 and 7, differing mainly from the filling apparatus 10 by the provision of a separate, hollow, radially sealed connecting piston 51, as well as in a modified eccentric shaft 52, which is actuated by a rotary handle 53. Moreover a modified filling union section 54 is provided, which can be screwed into the housing 55. In order to avoid repetition, a fresh description of like parts to those of the filling apparatus 10 is dispensed with and only a description of the modifications is undertaken below.

The filling union section 54 opens into a hollow cylindrical guide section 56, in which the connecting piston 51 is slidably guided, sealed by a sealing arrangement 57. The connecting piston 51 has an insertion neck 59 and a sealing arrangement 60 in the direction of a through opening 58 formed in the housing 50, the sealing arrangement corresponding to the seals 21 and 22 of the filling apparatus 10. The connecting piston 51 has an O-ring seal 61 on its rear side and a radial channel 62 leads to a pressure space 63 formed like an O-ring and with a surface 64 on which the filling medium acts axially. In addition a compression spring can be provided in a manner not shown in the filling union section 54, acting on the connecting piston 51 in the connecting direction. Furthermore an inlet filter, if desired a replaceable inlet filter, can be provided in or on the filling union section.

The eccentric shaft 52 now actuated by a handle 53 is not in this embodiment secured additionally by means of a safety pin 34, as in the filling apparatus 10, but attains a secure position for the actuating member 65 by a suitably profiled form of the actuating section 66, which can be seen clearly in FIG. 7. According to this the actuating section 66 has an approximately semi-circular cross-section with an abutment surface 67 for the retracted position of the displacement member 65 and an abutment surface 68 for securing the advanced position of the displacement member 65, whose flat rear end bears flat thereon under the engagement pressure of the biasing spring 69.

The operation of connecting the filling apparatus 50 corresponds roughly to that of the filling apparatus 10 in relation to the index pins 43, but no actuation of a safety pin is needed. Rather the handle 53 merely has to be turned through 90 degrees anticlockwise, so that the displacement member 65 passes from endwise abutment against the abutment surface 67 into abutment with the surface 68. The advantage of this comparatively simpler handling is supplemented by the further advantage that, after completing the connection of the filling apparatus 50, the sealing conditions in the region of the insertion neck 59 and the sealing arrangement 60 are improved by the filling medium pressure which acts on the surface 65 and moreover the displacement member 65 is pressed at its rear end on to the abutment surface 68 in addition to the action of the compression spring 69.

Figure 8:
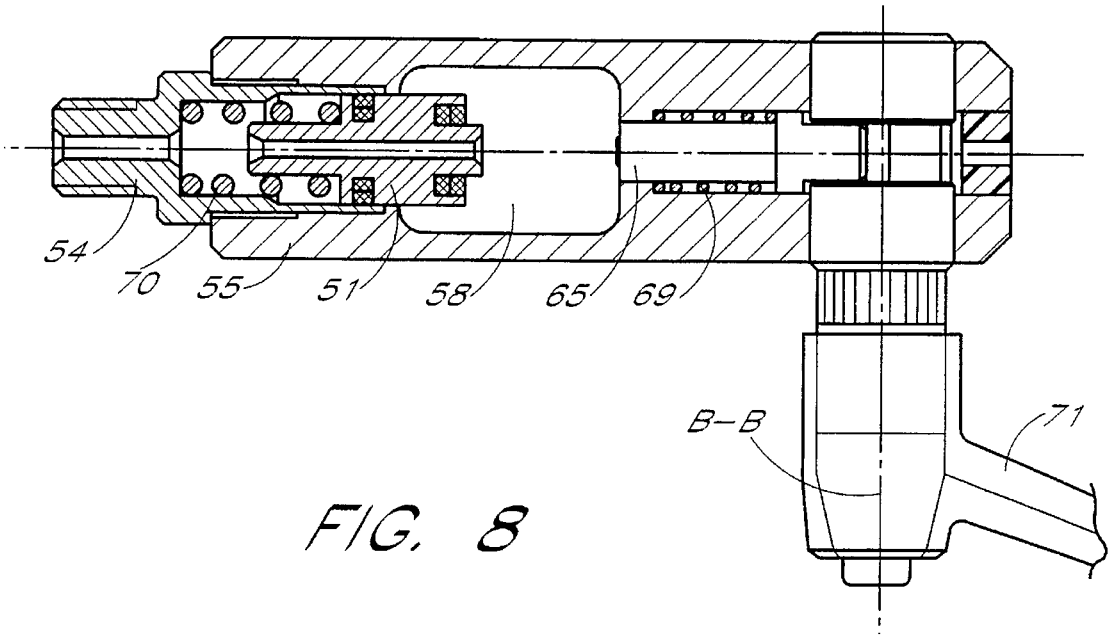
FIG. 8 is a sectional view of a further modified filling apparatus in decoupled position.
Figure 9:
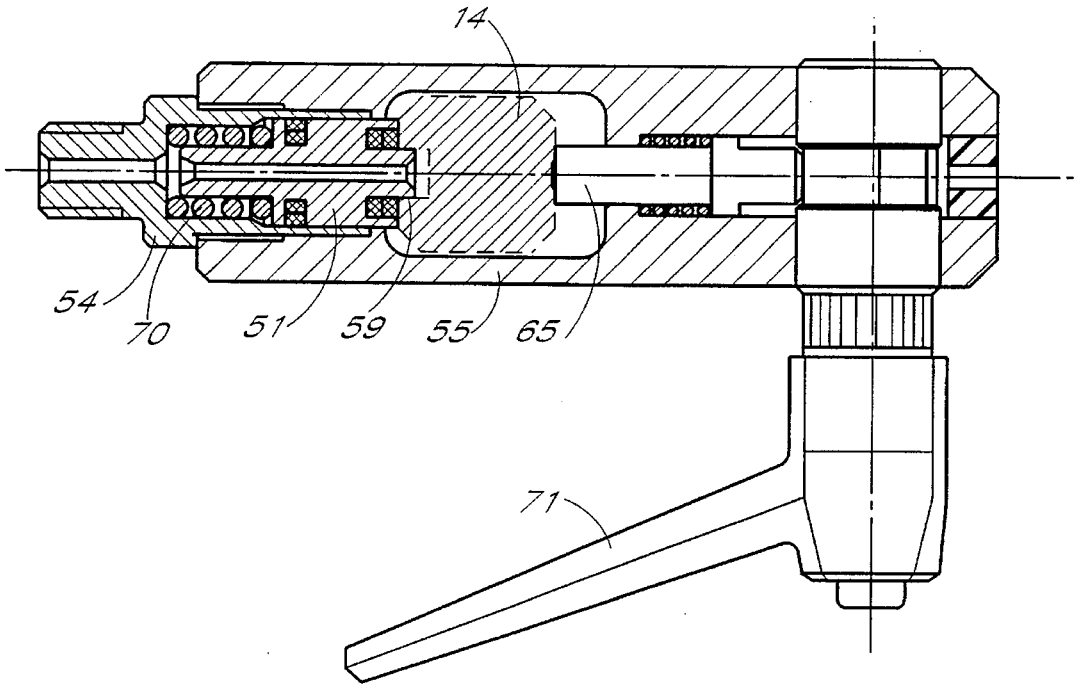
FIG. 9 is a sectional view according to FIG. 8 with the filling apparatus being coupled to a gas bottle valve similar as in FIG. 6.

A further modification of the filling apparatus 50 is shown in FIG. 8 and 9, differing only by the provision of a biasing spring 70 (instead of the seal 61) between the connecting piston 51 and the screwed-in filling union section 54. Thus, the connecting piston 51 is slidably guided within the filling union section 54 to project into the through opening 58 in the decoupled position according to FIG. 8 and to press against the force of the biasing spring 70 in the coupled position of the filling apparatus 50 (FIG. 9). Another modification is shown as regards the actuating means which is formed by a lever 71 being pivotable similar to the handle 33 of FIG. 2 about the axis B—B for about 60 to 180 degrees on coupling/decoupling of the filling apparatus.

We claim:

1. Filling apparatus for a gas bottle valve comprising:

a housing defining a longitudinal axis; a through opening intersecting said longitudinal axis formed in said housing adapted to receive, in use, said gas bottle valve;

a filling union section having a first portion fixed with respect to said housing and a second portion opening into said through opening by way of a sealing neck projecting generally along said longitudinal axis, said second portion formed as a separate, hollow, radially sealed connecting piston having at least one piston surface capable of being acted on by a filling medium in a first axial direction; and a displacement member positioned in said housing and adapted to be displaced along said longitudinal axis to displace said gas bottle valve located in said through opening in a second axial direction opposite said first axial direction and into engagement with said sealing neck.

2. Filling apparatus according to claim 1, wherein said connecting piston is resiliently biased in said first axial direction toward said gas bottle valve.

3. Filling apparatus according to claim 1, wherein said connecting piston is guided in a guide section formed in said filling union section.

4. Filling apparatus according to claim 1, wherein said displacement member is movable by means of an actuator disposed in said housing along an axis intersecting said longitudinal axis and having a non-axisymmetrical cross-section, said cross-section positioned to engage and displace said displacement member upon rotation of said actuator.

5. Filling apparatus according to claim 4, wherein an abutment surface is formed on said actuator for securing said displacement member in said advanced position.

6. Filling apparatus according to claim 4, wherein said actuator is operable by means of a rotatory handle.

7. Filling apparatus according to claim 4, wherein said actuator is operable by means of a pivoted lever.

8. Filling apparatus according to claim 1, wherein said displacement member is formed in the shape of a pin and is biased in said first axial direction away from its direction of entry into said through opening by means of a spring acting between said housing and said displacement member.

9. Filling apparatus according to claim 1, wherein said displacement member is secured in its advanced position, wherein said member projects into said through opening.

10. Filling apparatus according to claim 9, wherein an externally operable detent member is provided for securing said displacement member in said advanced position.

11. Filling apparatus according to claim 1, wherein said sealing neck comprises a sealing arrangement with an O-ring and a PTFE ring.

12. Filling apparatus according to claim 1, wherein said filling union section is screwed into said housing.

13. An apparatus for filling a gas bottle valve with a filling medium, comprising:

a rigid housing defining a longitudinal axis, said housing having a first section, a second section, and a third section disposed along said longitudinal axis with said second section intermediate said first and third sections, said second section defining a through opening intersecting said longitudinal axis adapted to receive, in use, said gas bottle valve, and said third section forming a passageway along said longitudinal axis communicating with said through opening;

a filling union section fixed to said first section adjacent said through opening and defining a guide section along said longitudinal axis;

a connecting piston positioned in said guide-section between said filling union section and said through opening and axially displaceable therewithin and including a sealing neck projecting into said through opening; and a displacement member adapted to be displaced along said passageway so as to displace said gas bottle valve located in said through opening into engagement with said sealing neck.

14. The apparatus of claim 13, wherein said connecting piston is formed as a separate, hollow, radially sealed element having at least one piston surface capabale of being acted on axially by said filling medium to force said connecting piston towards said through opening.

15. The apparatus of claim 13, wherein said connecting piston is resiliently biased along said longitudinal axis in a direction towards said through opening.

16. The apparatus of claim 13, wherein said displacement member is movable by means of an actuator disposed in said housing along an axis intersecting said longitudinal axis, said actuator having a non-axisymmetrical cross-section positioned to engage and displace said displacement member along said passageway upon rotation of said actuator.

17. The apparatus of claim 16, wherein said actuator is operable by means of a rotary handle.

18. The apparatus of claim 16, wherein said actuator is operable by means of a pivoted lever.

19. An apparatus according to claim 13, wherein said displacement member is a pin and is biased along said longitudinal axis away from its direction of entry into said through opening by means of a spring acting between said housing and said displacement member.

20. The apparatus of claim 13, wherein said sealing neck comprises a sealing arrangement with an O-ring and a PTFE ring.

21. The apparatus of claim 13, wherein said filling union section is screwed into said housing.

22. A method of introducing a filling medium into a gas bottle valve, comprising the steps of:

providing an apparatus having a rigid housing defining a longitudinal axis, said housing having a first section, a second section and a third section disposed along said longitudinal axis with said second section intermediate said first and third sections, said first section having a filling union section fixed therein defining an axial guide section, said second section defining a through opening intersecting said longitudinal axis, and said third section forming a passageway along said longitudinal axis communicating with said through opening;

introducing said gas bottle valve into said through opening;

displacing a member in a first axial direction along said passageway toward said through opening into engagement with said gas bottle valve;

displacing said gas bottle valve located in said through opening in said first axial direction into engagement with a sealing neck provided on a connecting piston axially displaceable in said guide section; and displacing said connecting piston in said first axial direction against a force acting on said connecting piston in a second axial direction opposite said first axial direction.

23. The method of claim 22, wherein said step of displacing said member comprises:

rotating an actuator disposed in said housing along an axis intersecting said longitudinal axis, the actuator having a non-axisymmetrical cross-section positioned to engage and displace said member upon rotation of said actuator.

24. The method of claim 22, further including the step of applying a biasing force between said filling union section and said connecting piston urging said connecting piston in said second axial direction.

* * * * *